United States Patent [19]

Finn et al.

[11] 4,016,666

[45] Apr. 12, 1977

[54] CLIPBOARD INCORPORATING WEAPON

[76] Inventors: Charles A. Finn, 2808 Todd; Albert Duckworth, 712 1/2 S. Pacific, both of Oceanside, Calif. 92054

[22] Filed: May 6, 1976

[21] Appl. No.: 683,887

[52] U.S. Cl. ..... 42/1 J; 42/1 R; 42/1 A; 89/36 E

[51] Int. Cl.[2] ..... F41C 9/00; F41H 1/00

[58] Field of Search ..... 42/1 J, 1 G, 1 A, 1 R; 89/36 A, 36 D, 36 E; 222/3, 491–497; 24/67 R, 67.3, 67.9, 67.11

[56] References Cited

UNITED STATES PATENTS

| | | | |
|---|---|---|---|
| 1,073,312 | 9/1913 | Woods | 42/1 J |
| 1,608,359 | 11/1926 | Biason | 42/1 J |
| 1,681,172 | 8/1928 | Cocho | 42/1 J |
| 3,385,601 | 5/1968 | Black | 42/1 G |
| 3,766,865 | 10/1973 | Cutler | 89/36 D |
| 3,866,242 | 2/1975 | Slagel | 89/36 A |

*Primary Examiner*—Charles T. Jordan
*Attorney, Agent, or Firm*—Duane C. Bowen

[57] ABSTRACT

A bullet-proof clipboard, for use by police officers and the like, with a weapon secured to the underside with concealing shielding. The barrel of the weapon points at the end of the clipboard normally away from the user. A trigger is exposed at a convenient location for firing. A light on the clipboard is directed at the location where papers are secured. Pointing of the clipboard at a person results in pointing the weapon at the person. The light can also be directed in the same direction as the weapon.

17 Claims, 11 Drawing Figures

4
4

CLIPBOARD INCORPORATING WEAPON

SUMMARY OF THE INVENTION

Our invention relates to protection of a police officer or the like who is carrying a clipboard.

An example of use of the clipboard is a police officer or the like who approaches an automobile he has stopped for a traffic violation. The officer can not in the absence of suspicious circumstances justify going to the stopped vehicle with a drawn sidearm. A number of officers are shot each year under these circumstances because the car occupants in such cases are involved in crimes other than traffic violations and think they may be apprehended for the other crimes. With use of our invention, in effect the officer has a drawn weapon that he can use if needed if the car occupant brings out a weapon. Alternatively or additionally, the officer can use the bullet-proof clipboard for a shield. In night conditions, papers on the clipboard can be lighted. Events can be recorded. Teargas may be used.

The objectives of our inventions include: to attach a weapon to a clipboard which may be pointed by pointing the clipboard and may be fired by convenient means; to provide suitable safety means; to mount the weapon on the clipboard in a concealed manner; to devise a clipboard of bullet-proof material so it can be used as a shield; to provide a light on the clipboard for night usage; and to devise an economical, simple and effective construction.

Our invention will be best understood, together with additional objectives and advantages thereof, from the following description, read with reference to the drawings, in which:

FIG. 8 is an exploded perspective view of a special configuration for tear gas, MACE or the like.

Figure 1:
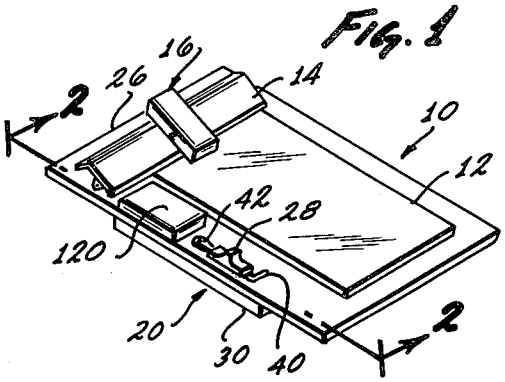
FIG. 1 is a perspective view of a specific embodiment of our new clipboard.
Figure 4:
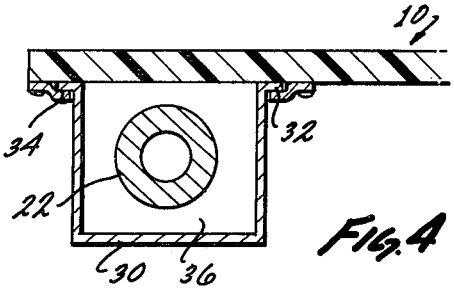
FIG. 4 is a view partly in section taken on line 4—4 of FIG. 3.
Figure 5:
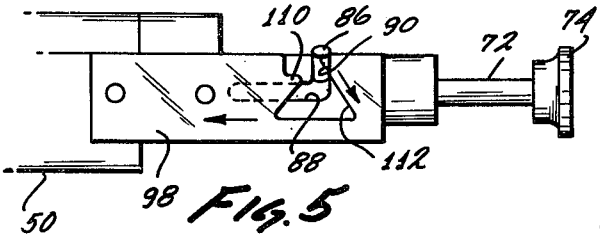
FIG. 5 is a view from above of portions of the weapon particularly an actuating plate and part of the breech block. The actuating plate is being moved in a direction releasing the firing pin and is to the left of its position in FIG. 3.
Figure 6:
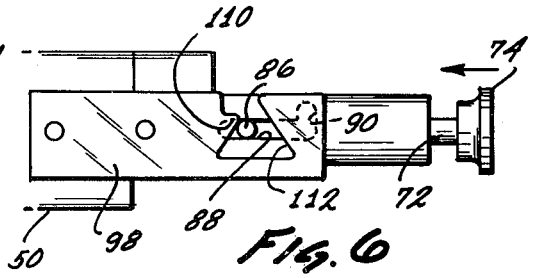
FIG. 6 is like FIG. 5 except the actuating plate has moved further to the left and the weapon has fired.
Figure 7:
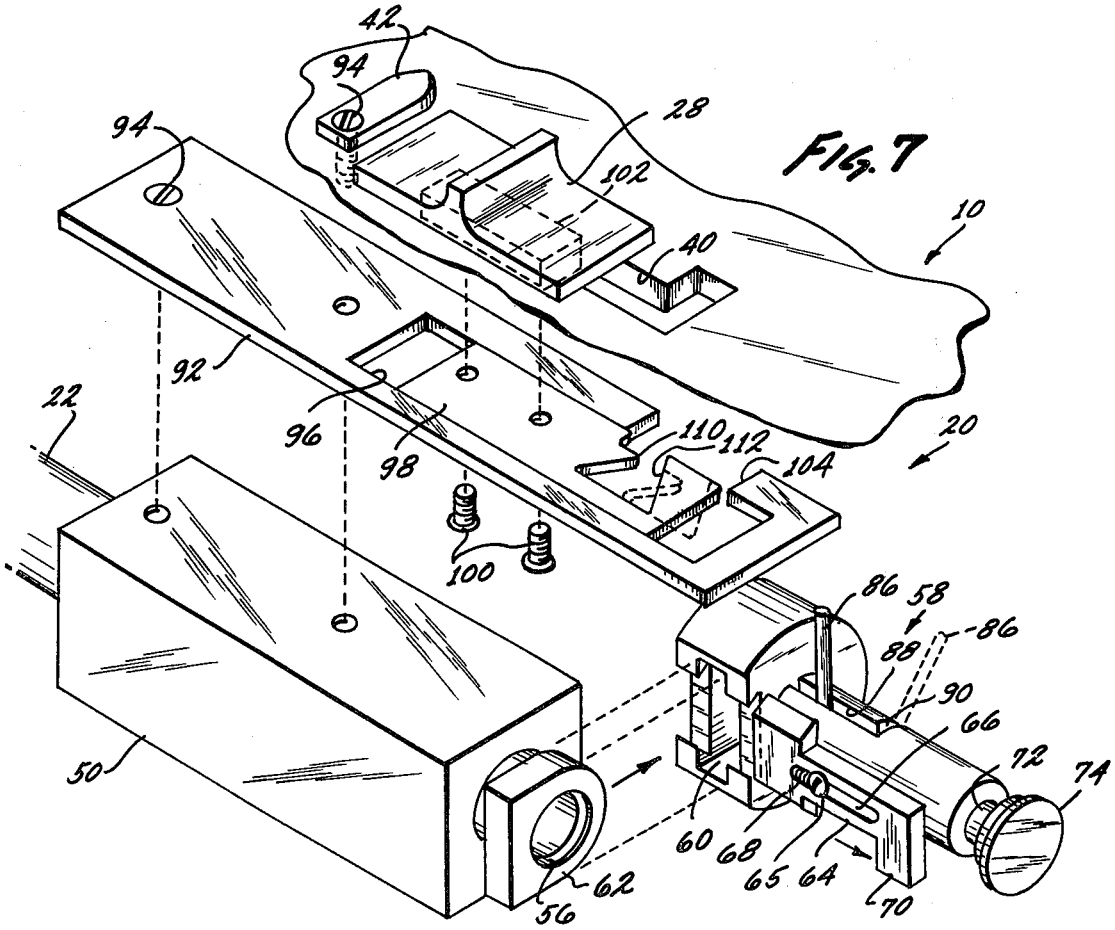
FIG. 7 is an enlarged, partial, exploded perspective view of portions of the assembly, and illustrates removal of the breech block from the barrel.
Figures 2, 3:
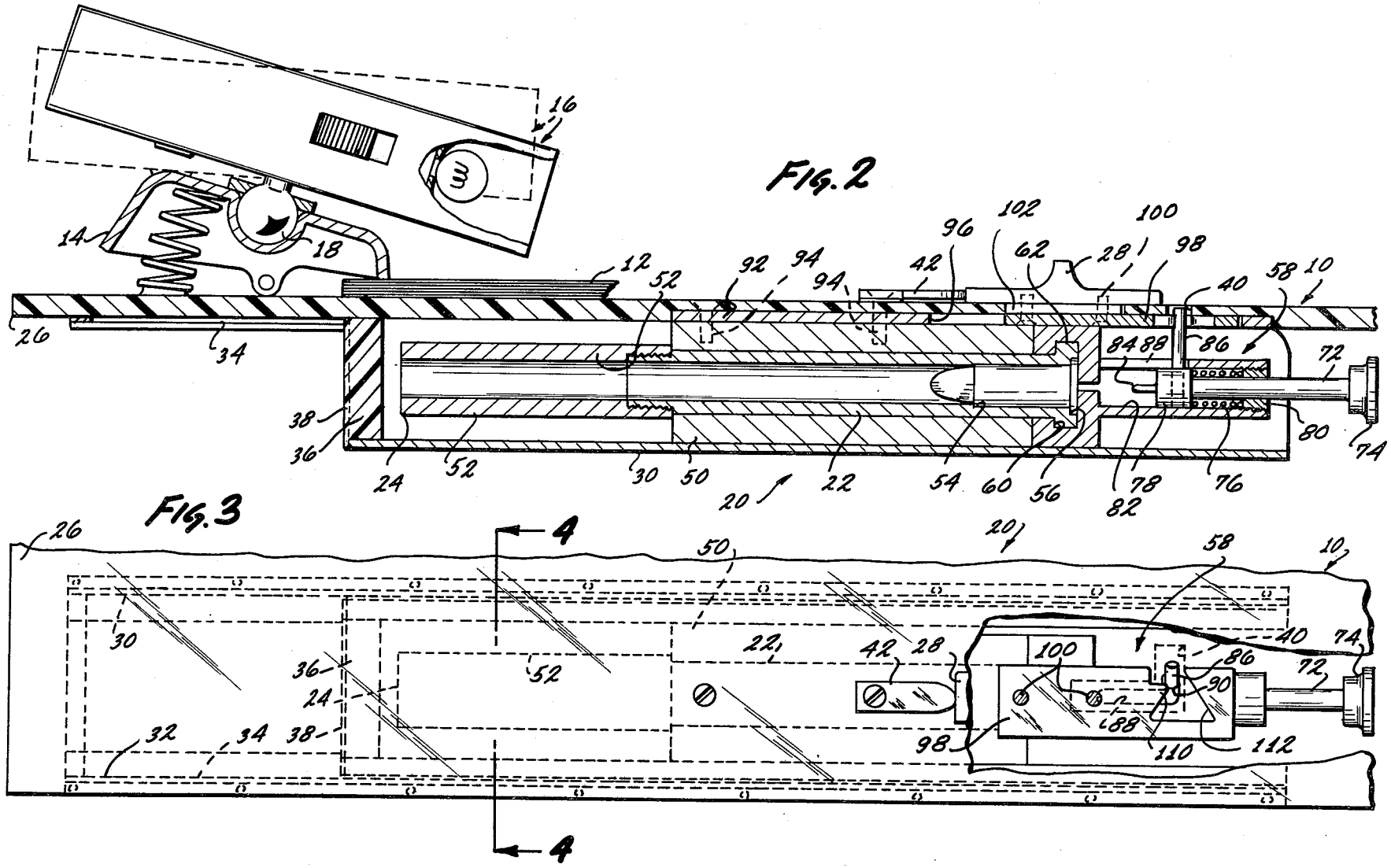
FIG. 2 is an enlarged view, partly in section taken on line 2—2 of FIG. 1. The light is shown in full lines in position to shine on papers on the clipboard and in dashed lines in position shining forwardly parallel to the barrel of the weapon.
FIG. 3 is a partial face view with portions broken away to illustrate structure that otherwise would be hidden. The weapon is shown in cocked, latched position.

One example of use of clipboard 10 has been given, i.e., to be held by a polie officer, highway patrolman, or the like as he approaches an automobile in a routine traffic violation situation wherein there is no reason to expect trouble but occasionally it does occur. The normal purpose of a clipboard is to hold papers, such as traffic violation sheet or book, which is illustrated at 12. The spring clip assembly 14, depicted at one end, to hold papers, is of conventional construction for clipboards, so the structure will not be described in detail, and other means for securing papers could be substituted.

Clipboard 10 preferably is formed of so-called "bullet-proof" material. Although it is common to term such materials bullet-proof, it would be more accurate to use the term "bullet-resisting", which is sometimes used in the art. Although bullet-proof has dictionary status, almost any material may be penetrated by some projectile, depending on the projectiles velocity and other characteristics, and the term deals with how relatively resistant the material is compared with other materials particularly to bullets. A bullet-proof glass deals with optical as well as strength characteristics. A common problem in the art today deals with weight versus strength characteristics, as for some applications, such as bullet-proof vests, there is a tradeoff of strength to weight the individual must carry, flexibility etc. Clipboard 10 could be made of a steel alloy, for example, but there are some other materials that might be preferable. The drawing is lined for plastic, because the newest materials, having the best bullet resisting qualities for their weight are types of fiber-reinforced plastics, in which, of course, the primary resistance depends on the types of fibers. Clipboard 10 should be made from the best bullet resisting material feasible, which is not two expensive and is not unsuitably heavy. As the art of fiber-reinforced plastics for such purposes is undergoing considerable development at present, the choice of material is likely to change from time to time. The purpose of making clipboard 10 of bullet-proof material, of course, is so that it can be used appropriately as a shield, which can be rapidly moved in front of the face and/or chest when the user thinks he is going to get shot. In the case of a shotgun burst, it would be hoped to protect the most vital body parts from the worst part of the blast, whereas with a handgun it would be hoped to stop, deflect, or minimize injury from a single bullet, at least one at a time. If the officer of patrolman were wearing a bullet resisting vest, then he would use the clipboard as a shied primarily for his head. It is a truism in police work to use any suitable object as at least partial sheild when possible, i.e., to stay shielded behind a police car or its door until passengers have dismounted from a suspicious vehicle that has been stopped, so some shield, if even a bullet resisting clipboard, on an average will be better than no shield at all, which is the normal condition of the police officer in approaching an automobile in a routine traffic violation stopping.

A battery powered light 16 has a pivotal mounting so that as shown, it can be pivoted between a first position to illuminate a sheet or book 12 on clipboard 10 to a second position directed substantially in the opposite direction, generally in the same direction that the weapon on the clipboard is directed. In the first position, papers on the clipboard can be illuminated when lighting is poor or non-existent, i.e., in night traffic violation work. In the second position, for example, the clipboard can be directed or "aimed" at another person, i.e., a car occupant stopped for a traffic violation in evening or nighttime work. This will not only give better illumination of the other person, it will also have some tendency to "blind" the other person or to confuse him. If the light is shining parallel to the barrel of the weapon, the light is usefl for aiming the weapon, i.e., if the light beam is centered on the other person then the weapon is likewise aimed.

A weapon 20 is secured to the clipboard 10. Weapon 20 has a barrel 22 and is adapted when actuated to project a disabling agency out of a first end 24 of barrel 22. The end 24 of barrel 22 is directed toward the end 26 of clipboard 10 having spring clip assembly 14. This means that when end 26 of clipboard 10 is directed toward a person when barrel 22 is directed or aimed toward that person. Note this is the normal general orientation of a clipboard, i.e., with the end of clipboard 10 having spring clip 14 directed away from the user so that papers 12 on clipboard 10 will be in position to be read or worked upon by the user. Weapon 20 has a trigger 28 for firing in position to be actuated by the user holding the clipboard.

The expression weapon and the expression "project a disabling agency" have been used. These expressions are meant to include any applicable weapon and disabling agency, i.e., bullets, tear gas, shotgun charge, etc. The purpose is evident and should not need explanation, i.e., the object is to disable the person fired upon and the agency may be possibly lethal, i.e., a bullet, or merely incapacitating, i.e., tear gas. One barrel size, for example, can adapt to calibers 0.45 spec., .44, and 0.410 or tear gas cartridge.

Preferably weapon 20 is concealed and is secured to the underside of the shee forming clipboard 10 and a near side edge thereof, i.e., the left side, so that trigger 28 will be in a good position for operation. If weapon 20 is on the left side, its housing may be grasped by the left hand to partly hold the clipboard while carrying or holding it and trigger 28 will be out of the way of a right-handed writer. Whereas it would be possible to mount an unconcealed weapon 20 on clipboard 10, more likely the weapon will be concealed, it is believed, i.e., in the example of the stopped motorist the average person might find display of a weapon of the clipboard rather startling!

The concealment means could take various forms but that shown is advantageous on various counts including easy access. A shielding housing 30 is essentially of U-shaped cross-section. The legs of the U-shape terminate in out-turned flanges 32 which are received in a pair of guide members 34 suitably secured to the flat sheet clipboard 10. Flanges 32 should fit in guides 34 closely enough to tend to stay in place but still be slidable so that housing 30 can be moved to a position out of the way for weapon access for loading, unloading, etc. At least the forward end of housing 30 should be covered by a blow-out plastic plug 36 fitting in the end of the housing. Plug 36 should be slightly oversized so as to stay in place by slight compression during insertion and preferably the end is flanged at 38 to limit how far it can be inserted. If plug 36 is made of light plastic material, it will be blown out of the way or the projectile will knock it out of the way or pass through it, when weapon 20 is fired, so as to not interfere with effective projection of the disabling agency.

Preferably the weapon is on the underside of clipboard 10 and the trigger 28 is on the upper side of the clipboard, which means clipboard 10 will have an opening 40 for connection of weapon 20 to trigger 28. The trigger 28 shown is of push button or slide variety and is actuated by sliding it toward the end 26 of clipboard 10 having clip assembly 14. A pivotal safety stop or latch 42 is spring biased to normally have a position preventing movement of trigger 28 in the actuation direction. Stop 42 is pivoted 90 degrees to one side before trigger 28 is actuated.

It will be understood that various varieties and sizes of weapons are applicable and different locations and types of triggers could be used. A prototype of the weapon and trigger assembly shown has worked satisfactorily. One feature of the design is economy of manufacture, simplicity and reliability of operation which are related factors. A single shot weapon is shown. Although a multiple shot weapon is applicable, that would increase costs. In the specific embodiment shown in the drawings the design choice is to limit costs so that the lower applicable selling price of a single shot weapon may make the invention more widely usable than might be the case in a more expensive, mutliple shot model. Eventually, both a single shot and a multiple shot configuration might be marketed.

In the configuration shown, a barrel 22 is received in a bore in a holding block 50 and has an extension 52, threadedly secured to barrel 22, abutting one end block 50. Barrel 22 is counterbored at 54 and 56 as a chamber for a shell and to receive the shell rim. A breech block 58 has a slot 60 directed to one side receiving a barrel flange 62. Flange 62 is retained in place within slot 60, in firing position, by a slidable secure catch 64 which is slidably mounted on a pin 65 in a slot 66 in catch 64 and is normally biased to locked position by a compression spring 68 acting between pin 65 and catch 64. A flange 70 on catch 64 may be pressed to move catch 64 to unlatched position for insertion and removal of flange 62 relative to slot 60. Breech block 58 thus may be detatched from barrel 22 for loading, reloading, etc.

Slidably mounted in block 58 is a firing pin 72 having an external knob 74 for compressing a coil firing spring 76 between a plunger 78 and a compression screw or plug 80 threadedly received in the end of the block bore 82. On the face of plunger 78 is a pin 84 which can be adapted to fire either a center fire or a rim fire cartridge.

Secured to plunger 78 and extending laterally relative to the axis of firing pin 72 is a pin arm 86 extending through an L-shaped slot 88 in breech block 58. When pin arm 86 is in leg 90 of slot 99, firing spring 76 is compressed but the weapon can't fire. When arm 86 is released from leg 90 of slot 88, the weapon fires.

Trigger 28 must act on lateral pin arm 86 to move arm 86 from leg 90 of slot 88 in order to fire the weapon. Arm 86 extends through opening 40 in clipboard 10. The lower surface of clipboard 10 is recessed to receive an actuating plate guide 92 which is suitably secured in place by screws 94 passing through guide 92 and into holding block 50 thereby also holding block 50 in place and thereby supporting the weapon in general.

Slidable within opening 96 of guide 92 is an actuating plate 98. It is secured by screws 100 to the lower boss 102 of trigger 28. Opening 40 is L-shaped with its leg extending longitudinally of clipboard 10 receiving boss 102 but too narrow to pass the upper part of trigger 28 or actuating plate 98 so that trigger 28 and actuating 98 are slidably supported. The other leg of the L-shaped opening 40 is superimposed to a slot 104 in guide 92, extending from guide opening 96 to the edge of guide 92, both being for the purpose of accomodating lateral movement of pin arm 86. Opening 96 in guide 92 is longer than the length of actuating plate 98 to accomodate its sliding movement from a rear latching position to a forward firing position.

As before noted, pin arm 86 is movable in L-shaped slot 88 in breech block 58 out of locked, cocked position in leg 90 of slot 88 in firing the weapon. Slot 104 in guide plate 92 corresponds to leg 90 of slot 88, meaning that when the end of pin arm 86 is in slot 104 it is also in leg 90 of slot 88, and as the pin arm moves out of slot 104 it also moves out of leg 90 of slot 88 of breech block 58. One function of actuating plate 98 is to latch pin arm 86 with latching surface 110 of plate 98 at the end of slot 104 of plate 92 to prevent pin arm 86 from moving out of slot 104 and firing the weapon. When the trigger is in its rear non-firing position, latching surface 110 retains pin arm 86 in slot 104. The second function of actuating plate 98 is to move pin arm 86 by means of camming surface 112 to cam pin arm 86 out of slot 104 of plate 92 and out of leg 90 of slot 88 to fire the weapon. As trigger 28 moves forwardly when pressed in that direction for firing, retaining surface 110 moves from the end of slot 104 and camming surface 112 acts positively on pin arm 86 to bias it out of slot 104 in plate 92 and out of retaining leg 90 of L-shaped slot 88 in breech block 58 thereby firing the weapon.

Weapon 20 then can be preloaded by operating secure catch 64 to release breech block 58 from barrel flange 62, whereupon a new cartridge can be loaded and breech block 58 can be reinstalled. Pin arm 86 will be returned to latching leg 88 of breech block slot 88 and to latching slot 104 of guide 92 by manually pulling firing pin 72 against spring 76 and turning pin 72 by force applied to knob 74.

FIG. 1 shows a small tape recorder 120 secured to the face of clipboard 10. Recorder 120 can be selected from one of the various small or miniature tape recorders on the market, such as the so-called "pocket tape recorders". Depending on size, the tape recorder may otherwise be secured to the face or underside of the clipboard or may be integrated in some other manner with clipboard 10. As is common with such recorders, it will have a button or other device to activate the unit when the user desires to record. The idea, generally, is to record what transpires in an arrest or the like, as this later may be disputed in court or in investigation proceedings. The concept of using the recorder 120, more specifically, is to record events involving use of weapon 20, as this information can be highly valuable if later a dispute arises as to whether the weapon was used properly or legally.

It is recognized that a new weapon often is simulated in toys. The claims should be interpreted to cover a simulated (toy) weapon as well as a real weapon. In other words, when it is stated that there is a weapon and the weapon has a barrel and is adapted when actuated to project a disabling agency out of the barrel, this should be interpreted to cover a toy in which a weapon firing a disabling agency is only simulated.

Figure 8:
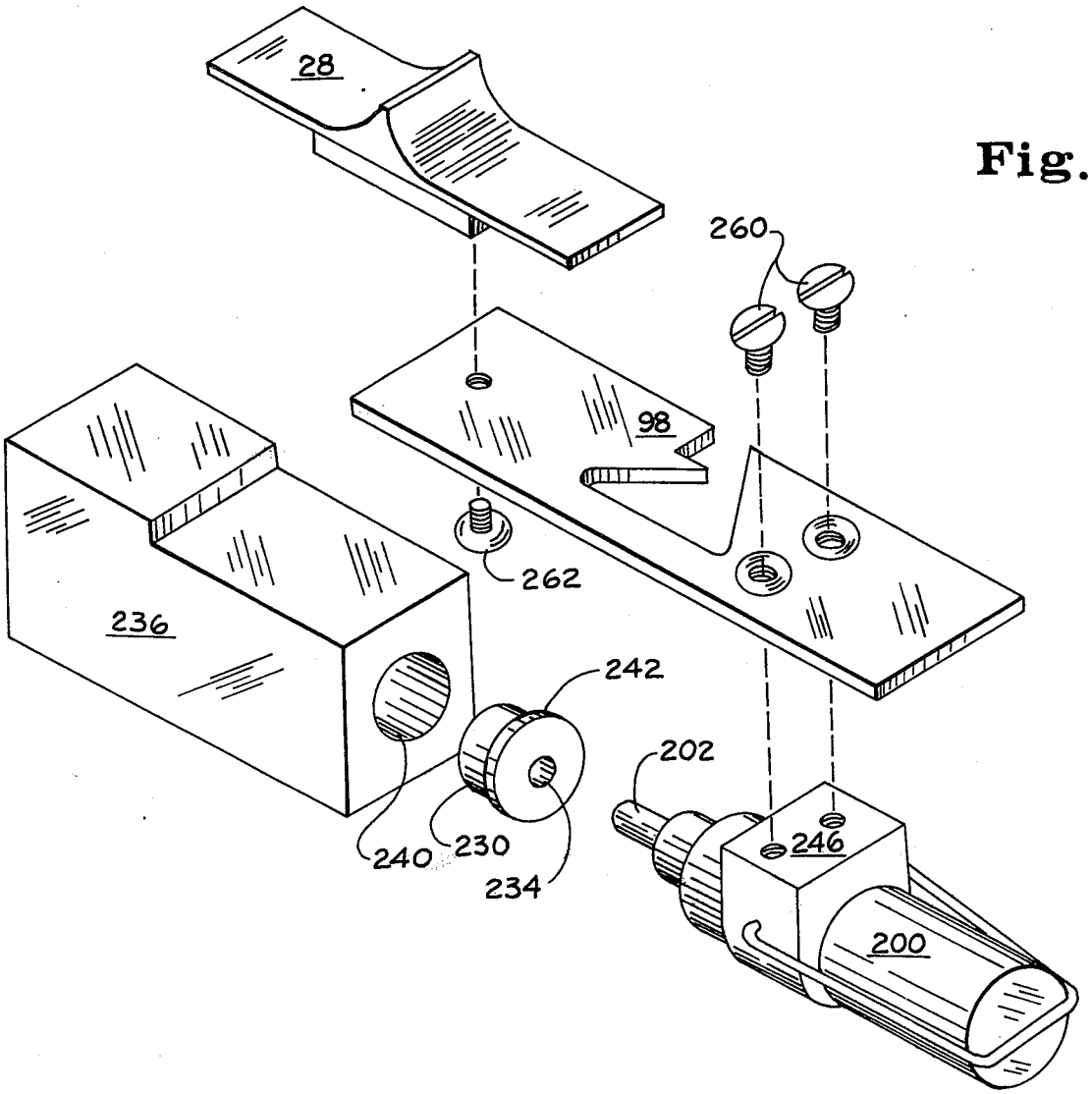

In certain police or like work it is possible to use tear gas or MACE or the like instead of bullets, with the objective of disabling another person instead of wounding or killing him. Clipboard 10 may be more acceptable for certain usages if tear gas or MACE is used, i.e., in the example of approaching a motorist stopped for a traffic violation but who occasionally may be a fugitive and may draw a gun. FIG. 8 and following figures are devoted to a configuration especially adapted for the use of a tear gas, MACE or like charge. When the expression is used in the claims concerning a "fluid pressurized disabling agency charge" or like expressions, the words should be interpreted to include tear gas, MACE or like materials presently used or later adopted. The word "fluid" is used to cover liquids, gases or mixtures thereof. The word "pressurized" concerns means to force the disabling agency toward the person to be struck, whether this be accomplished by pressurizing the disabling agency itself if it is a gas, whether air, $CO_2$, Freon or some other gas is used as the pressurizing agency, and whether the pressurizing agency is stored with the disabling agency or only acts upon it upon weapon firing. Tear gas at least traditionally concerned an agency blinding a person with tears. MACE at least originally concerned on agency acting upon the nervous system of the person. It should be evident that the present invention applies to a pressurized fluid disabling agency however it acts to disable or, in fact, however it is propelled, although we are showing a system particularly advantageous for firing tear gas or MACE in containers presently commonly used in police work and the like.

Figure 11:
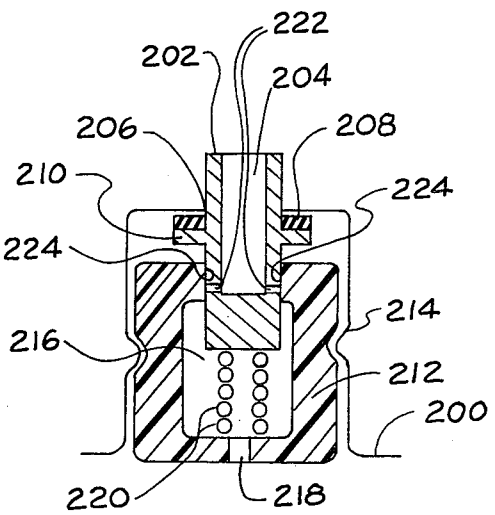
FIG. 11 is an enlarged view, partly in section, of the container nozzle construction.

FIGS. 8 to 11 show a configuration especially adapted for a standard container 200 of tear gas, MACE or other such pressurized fluid disabling agency charge. FIG. 11 shows a nozzle arrangement functionally similar to various push button pressurized fluid containers on the market. A button 202 has an end discharge aperture 204. The metal containers 200 has an end opening 206 through which button 202 extends. Sealing at this point is provided by a rubber washer 208 pressed between the end of the can around opening 206 and a flange 210 on button 202. A plastic insert 212 is secured in the end of container 200 by an internal annular rib 214 formed in container 200. Insert 212 has a central cavity 216 with a bottom opening 218 and a compression spring 220 normally pressing button 202 to an upper position as viewed in which there will be no fluid discharge through aperture 204. Central aperture 204 has side ports 222 normally sealed from cavity 216 by the end walls 224 of insert 212. It will be observed that discharge of pressurized fluid will occur from container 200, through insert opening 218, through cavity 216, through ports 222, and out button aperture 204 when button 202 is inwardly pressed so that ports 222 communicate with cavity 216.

Figure 9:
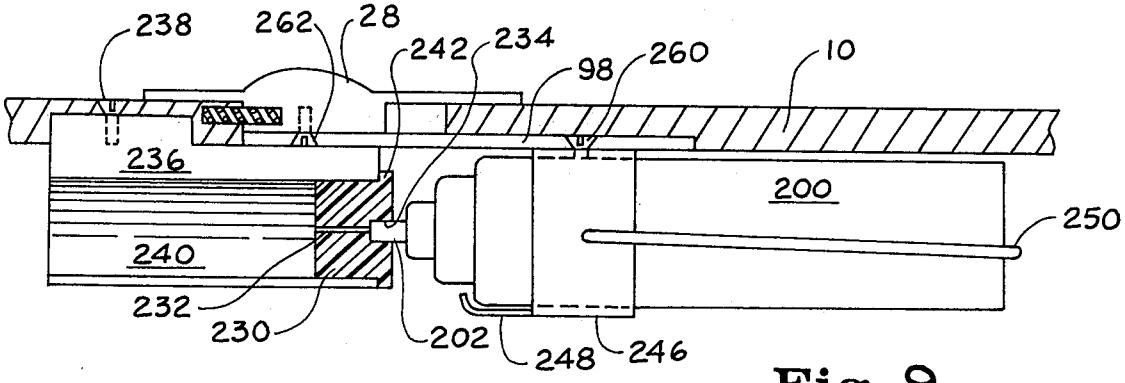
FIG. 9 is a side view, partly in section, of the FIG. 8 construction.
Figure 10:
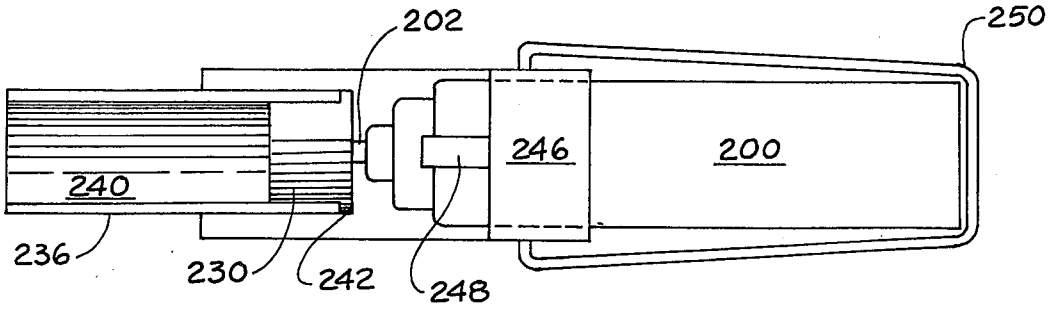
FIG. 10 is like FIG. 9 only being a bottom view.

In FIGS. 8 to 10 is shown a spool body 230 against which button 202 is pressed to actuate container discharge. Spool 230 has a through passageway 232 and has an end recess 234 receiving button 202, whereby container discharge is through passageway 232. In the FIG. 8 to 10 configuration it is intended that parts other than spool 230 and the support for container 200 be identical with the parts in the configuration of FIGS. 1 to 7 for firing bullets, shotgun shells, etc. Spool 230 is received in a member 236 which can be identical to holding block 50 and is secured to the clipboard 10 similarly as by screw 238. Block 236 has a through cylindrical passage or bore 240 receivinbg spool 230, which has an end flange 242 which abuts the end of block 236. Bore 240 acts as a barrel in discharge fluid.

Securing means for the container include an annulus 246 in which container 200 is fitted. A finger 248 forms an abutment so that container 200 will not normally seat far enough toward spool 230 to press button 202. A wire bail 250 is pressed up as viewed behind container 200 to hold it in place when it is mounted in annulus 246. As before mentioned, parts can be mostly the same in the FIG. 1–7 and the FIG. 8–10 configuration, and actuating plate 98, trigger 28 and clipboard 10 are given the same numbers. Annulus 246 is suitably secured to actuating plate 98 by screws 260 and actuating plate 98 is secured to trigger 28 by screw 262.

It will be understood that as trigger 28 is pressed to the left as viewed in FIG. 9, actuating plate 98 will move annulus 246 and container 200 to the left thereby pressing button 202 against pool 230 and causing fluid discharge from container 200.

Member 10 has been termed a "clipboard". In construction of the claims this term should be construed to cover any member functionally equivalent in police work and the like, i.e., a "pinch book" used in traffic work sometimes is a book with a hard back cover, a front cover and an end spring mechanism, essentially U-shaped in cross-section, to resiliently grip a pad having arrest forms. Sometimes a clipboard or the like will have a lower compartment of storage of copies to be retained. The board or the like would be functionally equivalent if papers, such as a book of traffic "tickets" were secured by screws set in end openings, by rings in pad end openings, etc., so, again, the term clipboard should be construed as covering members functionally equivalent in police work and the like, i.e., a support for papers and pads, separate or integral.

From the foregoing it will be understood how the objectives of our inventions have been met and additional objectives and advantages. We don't wish to be limited to the exact details of construction shown, but instead we wish to cover those modifications thereof that will occur to those skilled in the art upon learning of our invention, and properly in the scope thereof.

We claim:

1. The improvement in a clipboard for purposes of defense, comprising:

a. said clipboard including a flat sheet and means to secure papers on the upper face thereof, b. a weapon secured to said clipboard, said weapon having a barrel and being adapted when actuated to project a disabling agency out of a first end of said barrel, said first end of said barrel being directed toward a first end of said clipboard whereby when said clipboard first end is directed toward a person said barrel first end is also directed toward that person, and c. said weapon having a trigger for firing said weapon in position to be actuated by one holding said clipboard.

2. The subject matter of claim 1 in which said clipboard is elongated and said means to secure papers is at said first end of said clipboard, whereby, when papers are secured to said clipboard in normal position for reading from the opposite end of said clipboard and the clipboard is being held for reading, said barrel first end is directed away from the user.

3. The subject matter of claim 2 in which there is light means secured to said clipboard and adjustably mounted so that said light means can be directed to shine toward the location of papers on said upper face of said board secured by said means to secure papers or said light means can be directed to shine in the same direction said barrel is aimed thereby to illuminate whatever said barrel is pointed at.

4. The subject matter of claim 1 in which said flat sheet is formed of bullet-proof material, whereby said clipboard can be used as a shield.

5. The subject matter of claim 1 in which there are shielding means around the sides of said weapon thereby concealing the same.

6. The subject matter of claim 5 in which said weapon is secured to the underside of said sheet and said shielding means is U-shaped in cross section so that said sheet conceals said weapon from above and said shielding means conceals the other sides of said weapon, said shielding means being slidably mounted whereby said shielding means can be slid to a position exposing said weapon for servicing, there being a blow-out plug in the end of said shielding means in front of said barrel first end.

7. The subject matter of claim 1 in which said weapon is secured to the underside of said sheet near a side edge thereof and said sheet has an opening therein, said trigger having at least a portion thereof disposed above the upper surface of said sheet and having means extending through said opening and connecting to said weapon.

8. The subject matter of claim 7 in which said trigger acts by sliding parallel to the upper surface of said sheet.

9. The subject matter of claim 1 in which there is a breech block at the other end of said barrel, said breech block having a spring-loaded firing pin and an arm secured to said firing pin and extending laterally therefrom, said breech block having an L-shaped slot therein with a leg of said slot receiving said arm in a spring-compressed, cocked position of said firing pin, an actuating plate below said trigger and secured thereto and means mounting said trigger and actuating plate for sliding movement between a non-firing position and a firing position, said actuating plate having an opening therein receiving said arm and having a first latching surface holding said arm in said leg of said slot in the non-firing position of said plate and trigger and having a second camming surface acting against said arm to move said arm out of said leg of said slot as said plate and trigger move from said non-firing position toward said firing position thereof.

10. The subject matter of claim 1 in which there is a tape recorder secured to said clipboard so that a recording can be made of sounds in events involving use of said weapon.

11. The improvement in a clipboard for purposes of defense, comprising:

a. a clipboard, a weapon secured to said clipboard, said weapon having means operative when actuated to project a disabling agency so that when said clipboard is held in the hands of a user said weapon can be pointed at another person, and c. said weapon having actuation means operable by the user to operate said weapon.

12. The subject matter of claim 11 in which said weapon has a fluid pressurized disabling agency charge.

13. The subject matter of claim 11 in which said clipboard includes a flat sheet and said weapon is directed to discharge said disabling agency charge in a direction generally parallel to the plane of said sheet.

14. The subject matter of claim 13 in which there is a container containing said fluid pressurized disabling agency charge and said container having a discharge nozzle, means operative to act on said discharge nozzle to open said nozzle for discharge, said container and said means operative to act on said nozzle being mounted in a manner permitting relative movement therebetween, and said actuation means acting to relatively move said container and said means operative to act on said nozzle.

15. The subject matter of claim 14 in which said discharge nozzle has an end button with an end aperture operative to discharge by inward pressing of said button and in which said means operative to act on said nozzle includes a body having a recess receiving the end of said button and having a through passageway aligned with said aperture.

16. The subject matter of claim 15 in which said body has a spool shape with an end flange on its end toward said container and a barrel member secured to said clipboard in which said body fits with said end flange abutting an end of said barrel member, whereby said barrel member holds said body to press on said button as said actuation means acts to relatively move said container and said means operative to act on said nozzle, and said container discharges through said through passageway in said body and through said barrel member.

17. The subject matter of claim 16 in which said actuation means includes a trigger slidably mounted relative to said clipboard and there being a ring connected to said trigger and receiving said container, whereby said actuation means acts by moving said trigger, ring and container toward said body to inwardly press said button.

* * * * *